US006393873B1

(12) United States Patent
Myerscough

(10) Patent No.: US 6,393,873 B1
(45) Date of Patent: May 28, 2002

(54) WASHING MACHINE

(75) Inventor: Martin William Myerscough, Suffolk (GB)

(73) Assignee: Monotub Industries, PLC (GB)

( * ) Notice: Subject to any disclaimer, the term of this patent is extended or adjusted under 35 U.S.C. 154(b) by 0 days.

(21) Appl. No.: 09/692,771

(22) Filed: Oct. 18, 2000

Related U.S. Application Data

(63) Continuation of application No. PCT/GB99/00977, filed on Mar. 29, 1999.

(30) Foreign Application Priority Data

Apr. 22, 1998 (GB) ..... 9808606

(51) Int. Cl.[7] ..... D06F 21/02; D06F 21/10
(52) U.S. Cl. ..... 68/58
(58) Field of Search ..... 68/58, 23.5

(56) References Cited

U.S. PATENT DOCUMENTS

| | | | | | |
|---|---|---|---|---|---|
| 1,487,907 | A | * | 3/1924 | Yates | 68/58 |
| 2,397,268 | A | | 3/1946 | Jorgenson et al. | |
| 2,645,548 | A | | 7/1953 | Kreitchman et al. | |
| 2,899,816 | A | | 8/1959 | Jacobson, Jr. | |
| 3,262,218 | A | * | 7/1966 | Cymbalisty | 68/58 X |
| 3,344,447 | A | * | 10/1967 | Candor et al. | 68/58 X |

FOREIGN PATENT DOCUMENTS

| | | | | |
|---|---|---|---|---|
| DE | 514 717 | A | 10/1959 | |
| DE | 42 02 760 | A | 8/1993 | |
| EP | 0 146 719 | A | 3/1985 | |
| EP | 0 381 423 | A | 8/1990 | |
| EP | 725 719 | A | 3/1995 | |
| FR | 1 190 034 | A | 10/1959 | |
| FR | 1 282 292 | A | 6/1962 | |
| GB | 697523 | * | 9/1953 | 68/58 |

* cited by examiner

*Primary Examiner*—Philip Coe
(74) *Attorney, Agent, or Firm*—Fredrikson & Byron, P.A.

(57) ABSTRACT

Washing machine having a rotatable drum (1) which holds the items to be washed. The drum (1) may be removable from the machine, like a basket. A number of channels (6) extend along the length of the drum (1). Water is introduced into the upper channels (6) via a pump, valve (9, 10, 11, 12) and radial ducts (5) to the rear of the channels (6). The water showers from the upper channels (6) onto the items in the drum (1).

21 Claims, 2 Drawing Sheets

WASHING MACHINE

CROSS REFERENCE TO RELATED APPLICATIONS

The present application is a continuation of and claims priority to International Application No. PCT/GB99/00977 (published as International Publication No. WO 99/54540), filed Mar. 29, 1999 and designating the United States, which in turn claims priority from British Application No. 9808606.9, filed Apr. 22, 1998.

BACKGROUND TO THE PRESENT INVENTION

The present invention relates to washing machines, and in particular to a system for introducing water into the drum in which the items to be washed are contained.

A conventional washing machine includes a fixed water tank within which is provided a rotatable, perforated drum which contains the items to be washed. Water is introduced into the water tank to a predetermined level, and this water passes through the perforations in the drum to soak the items to be washed. As many of the items in the drum are above the level of the water, it is necessary to agitate the items to be washed so that each of these is moved below the level of the water from time-to-time. With this arrangement, it is necessary to use a fixed predetermined volume of water irrespective of the volume or absorbency of the items to be washed, and therefore where only a few items are required to be washed, there is waste of water. This problem is especially noticeable where the drum rotates about an axis inclined to the horizontal. In this case, due to the inclination of the drum, the maximum height of the items contained in the washing machine will be greater than the same items when provided in a horizontally mounted drum, and therefore more water is required to ensure there is a sufficient water level in the drum to saturate all the items contained in it. This has limited the angle at which drums in washing machines can be inclined.

In a conventional washing machine, in addition to moving the clothes through the water, agitators provided on the inside of the rotatable drum may scoop up water as the drum rotates, and lift this water towards the top of the drum from where the water falls onto the top of the clothes. A system has been commercialised by Zanussi, under the name "JetSystem", in which water is jetted into the rotatable drum to shower the items with water. The system comprises a number of jets provided at the top of the water tank to jet water into the rotatable drum through the perforations provided in the drum. This system has been further developed and commercialised under the name "JetSystem Rsi". It is believed that the development was necessary as the majority of the water jetted from the top of the water tank in the original system hits the material of the drum rather than passing through the perforations, and therefore bounces off the drum and is deflected around the outside of the drum rather than passing into the drum and showering the items to be washed. Accordingly, the "JetSystem Rsi" system jets water through the open front of the rotatable drum. In this case, there is a seal between the fixed water tank and the washing machine cabinet around the front opening of the machine. A jetting nozzle is provided through this seal, and directs water generally parallel to the axis of rotation of the drum. The problem with this system is that the items to be washed are generally higher than the level at which water is injected, and therefore the water is jetted against the side of the items to be washed rather than showering the items from above. This means the water penetrates through the first few layers of the items to be washed, and then drops to the bottom of the water tank without being absorbed by all the items to be washed, and therefore without wetting all of the items sufficiently.

SUMMARY OF THE INVENTION

According to the present invention, a washing machine includes a rotatable drum having a number of channels extending substantially along its length, the channels including holes along their length, generally radial connecting ducts leading from the centre of the drum to the channels, a pump arranged to pump water through the connecting ducts and into the channels and valve means interposed between the pump and the connecting ducts so that, in use, water provided by the pump is directed by the valve means towards the channel or channels in the upper half of the drum and from there drops onto items in the drum.

With a drum according to the present invention, the water partially or completely fills the channel or channels in the upper half of the drum, and is discharged at points along the length of the drum, thereby ensuring that the water is spread over all the items in the drum, and thereby ensuring that all items are wetted sufficiently with minimum water usage.

It is preferred that the drum includes an axial water inlet at the rear of the drum, and the generally radial ducts are also provided along the back of the drum to the rear end of each channel extending substantially along the length of the drum.

Preferably three or more channels are provided, equally spaced around the inner circumference of the drum. This allows for a substantially continuous shower of water onto the items in the drum.

The channels are preferably provided parallel to the axis of rotation of the drum, although they may be horizontal or decline with respect to the horizontal when at their uppermost position. The pump pumps water into the end of the channel and forces the water along the length of the channel as the water is dispensed through the holes in the channel to ensure that water is discharged along the entire length of the channel. The valve means controls the supply of water to the channels so that water is generally not supplied to the lowermost channel or channels. This is advantageous since, if water was supplied to all channels, the water would preferentially flow to the lowermost channel, and therefore there would be insufficient water pumped to the upper channel or channels from which water is showered onto the items in the drum.

The valve means may include a closed-ended spigot which extends into the drum from the centre of the rear plate and which includes a hole directed generally upright in its side wall, and the generally radial ducts may terminate at the centre of the drum by joining a sleeve, the sleeve fitting over, being capable of rotating with respect to, and forming a liquid-tight seal with the outside of the spigot. With this arrangement the end of whichever duct or ducts are aligned with the hole in the spigot at any instant as the drum rotates, receives the flow of water from the pump and through the hole in the spigot. The angular extent over which water is supplied to the channels is set by determining the angular extent of the hole in the spigot.

Alternatively the valve means may be formed by providing an axial hub from which the radial channels open, and providing a loose disc within the hub, the disc having a diameter smaller than that of the hub. The disc includes generally radial grooves through which water can pass. As the disc is loosely provided within the hub, the disc will fall, under gravity, towards the bottom of the hub, thereby blocking the openings to the lower radial channels, whilst allowing water to pass through the radial grooves and into the unblocked upper radial channels. As the hub rotates, and due to the different curvature of the hub and the disc, the openings to the radial channels will gradually be opened as the channel is rotated upwardly, and gradually closed as the channel is lowered. This ensures that the longitudinal channel can be filled with water as it approaches its discharge position, and discharges its water along its entire length before it moves back to the lowermost position.

The channels may be curved around part of the circumference of the drum as they extend towards the front of the drum. In this case, where the drum is arranged to rotate about an inclined axis, as the drum rotates, water flow along the channels is aided by gravity as the lowest point of the channel will move towards the opposite end of the drum as the drum is rotated.

In this case each of the channels preferably extends about 90° around the drum so that, when one end of the channel is at its highest position, the other end is at a substantially lower position.

The channels extending along the length of the drum are advantageously raised radially inwardly of the inner surface of the drum, and thereby act as agitators to agitate the items in the drum during rotation of the drum.

The drum may be fixed permanently within the washing machine, in which case the drum is directly rotatably driven. However, it is preferred that the drum is in the form of a removable basket which is received within a permanently fixed rotatable drum of the washing machine. In this case, the basket can be filled with items to be washed, and placed in the washing machine when full of items, and then, after the wash, can be removed with all of the washed items for carrying these to be dried. This is much easier than adding and removing the items to and from the washing machine individually.

Where the drum is a removable basket, the generally radial channels and/or all or part of the valve means may be provided in the back of the basket, or on the rear of the drum which receives the basket.

BRIEF DESCRIPTION OF THE DRAWINGS

An example of the present invention will be described with reference to the accompanying drawings, in which.

DETAILED DESCRIPTION OF PREFERRED EXAMPLES

Figure 1:
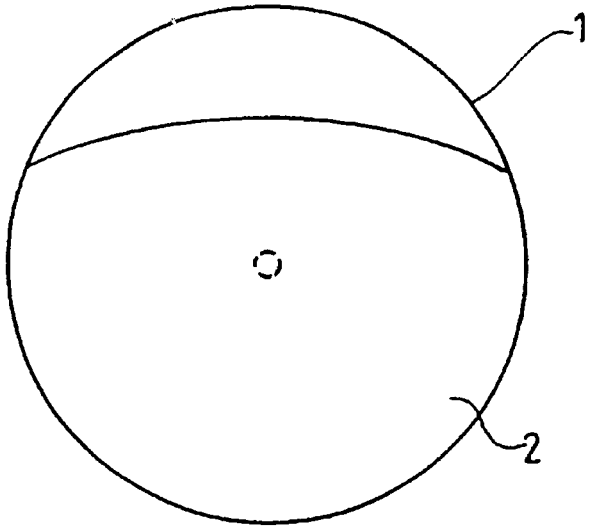
FIG. 1 shows an end view of a rotatable washing machine drum including items to be washed.

FIG. 1 shows items 2 for washing which are provided in a generally cylindrical drum 1. As shown, the items 2 generally fill the drum 1 but are spaced from the top of the drum 1. This arrangement of items 2 in the drum 1 is maintained during the washing cycle, even when the drum 1 is rotated.

Figure 2:
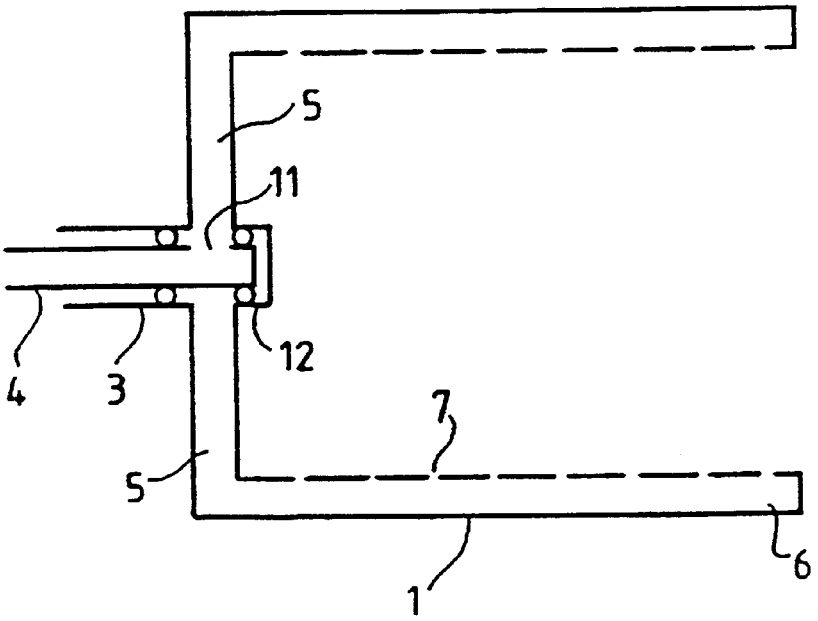
FIG. 2 shows a cross-sectional side view of a drum according to the present invention.
Figure 3:
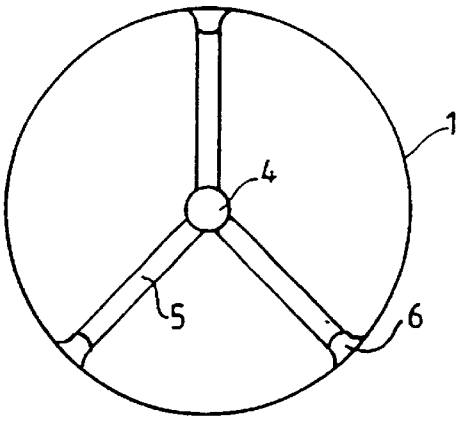
FIG. 3 shows an end view of the drum of FIG. 2.

FIG. 2 shows a side view of a drum 1 according to a first example of the present invention. The drum 1 is mounted for rotation on a spindle 3 which includes a water inlet 4. As best seen from the end view of FIG. 3, three radial channels 5 are provided on the back of the drum 1 from the water inlet 4 to three longitudinal channels 6 extending along the length of the drum 1. Each of the channels 6 includes holes 7 provided at intervals along the length of the channels 6.

One form of valve has the water inlet 4 formed as a closedended spigot which extends into the drum 1 from the centre of its rear plate. The spigot 4 includes a hole 11 directed generally upright in its side wall. The generally radial ducts 5 terminate at the centre of the drum by joining a sleeve 12. The sleeve 12 fits over the spigot 4 and is capable of rotating and forming a liquid tight seal with respect to the outside of the spigot 4. With this arrangement the end of whichever duct 5 is aligned with the hole 11 in the spigot 4 at any instant as the drum 1 rotates receives the flow of water from the pump and through the hole 11 in the spigot 4. The angular extent over which water is supplied to the ducts 5 is controllable by controlling the angular extent of the hole 11 in the spigot 4.

Figure 4:
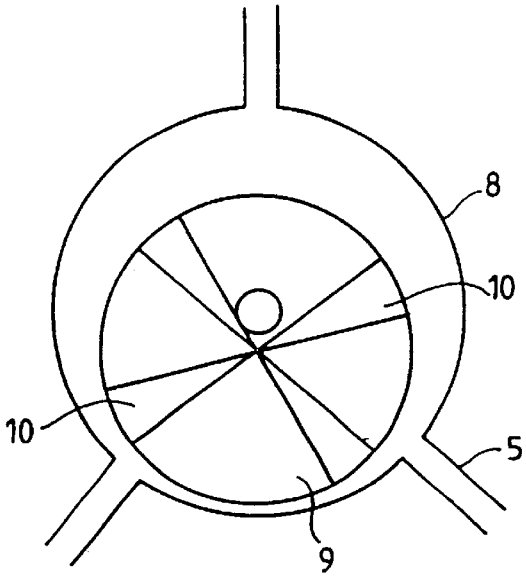
FIG. 4 shows a cross-sectional end view of an alternative valve arrangement.
Figure 5:
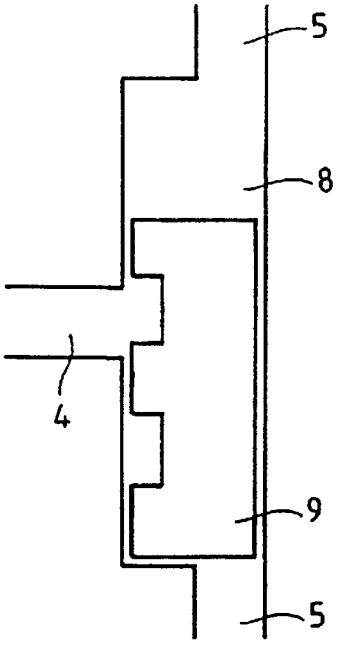
FIG. 5 shows a cross-sectional side view of the valve of FIG. 4.

As best seen in FIGS. 4 and 5, an alternative valve arrangement is provided to control the flow of water from the inlet 4 into the radial channels 5 and to the longitudinal channels 6. The valve comprises a hub 8 into the centre of which the water inlet 4 opens, and from the circumference of which the radial channels 5 open. A disc 9 having a diameter smaller than that of the hub is loosely provided within the hub. The disc 9 includes a number of generally radial grooves 10.

As the disc 9 is held loosely within the hub 8, gravity pulls the disc 9 to the bottom of the hub 8. In this position, the edge of the disc 9 overlies the opening to the lower radial channels 5, thereby preventing water entering the hub 8 through the water inlet 4 passing into the lower radial channels 5. As the disc 9 is smaller than the hub 8, the openings to the upper radial channels 5 are not closed by the disc 9. Therefore water entering the hub 8 through the inlet 4 is able to pass along the grooves 10 in the disc 9 into the space above the disc 9 within the hub 8, and from there into the upper radial channels 5.

As the drum 1, and hence the hub 8 and radial channels 9, rotate, the openings to the lower radial channels 5 are raised. Gravity holds the disc 9 at the bottom of the hub 8, and therefore the openings to the radial channels 5 are opened, and water entering the hub 8 through the inlet 4 is able to pass into the channels 5. At the same time, the openings to the upper radial channels 5 are lowered, and therefore become blocked by the disc 9. Accordingly, the water entering the hub 8 is able to pass into the radial channels 5 as the openings to the channels 5 move from a lower position to an upper position due to rotation of the drum 1, and is gradually prevented from entering the channels 5 as the opening to the channels 5 move from an upper position to a lower position due to the continued rotation of the drum. In this way, the water entering the hub 8 is only supplied to the elevated longitudinal channels 6, thereby ensuring water within the elevated channels 6 is discharged through holes 7 in the channels and into the drum 1 at a height above the items 2 to be washed.

By discharging the water into the drum 1 along the length of the drum 1, from above the height of the items 2 in the drum, the water will spread over the items 2, and will be absorbed by the items 2 in the drum 1.

Figure 6:
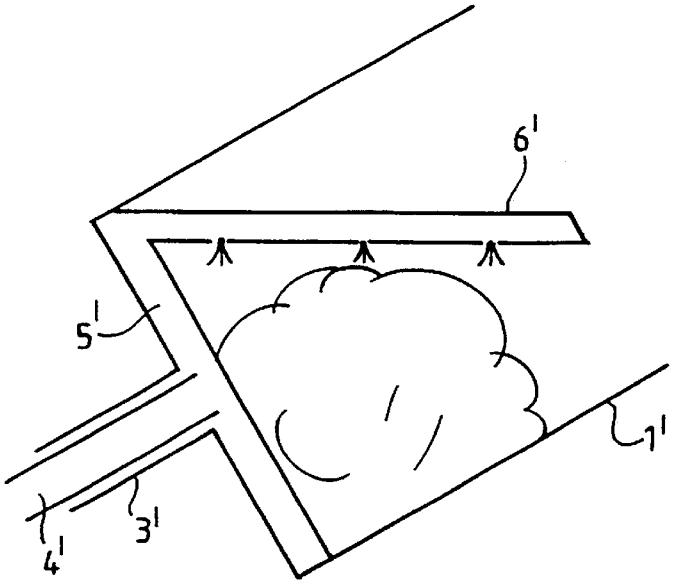
FIG. 6 shows a side view of a drum according to an alternative example of the present invention.

An alternative example of the present invention is shown in FIG. 6. In this example, the channels 6' do not extend in a straight line parallel to the axis of rotation of the drum 1' but curve around the inner circumference of the drum 1' as they extend from the back to the front of the drum 1'. The rotation of the drum 1' moves the highest point of the channel 6' from the back of the drum 1' to the front of the drum 1', thereby tending to cause the water to be discharged, progressively, along the length of the drum 1'.

What is claimed is:

1. A washing machine including a rotatable drum having a number of channels extending substantially along its length, the channels including holes along their length, generally radial connecting ducts leading from the center of the drum to the channels, a pump arranged to a pump water through the connecting ducts and into the channels and a valve interposed between the pump and the connecting dusts so that, in use, water provided by the pump is directed by the valve towards the channel or channels in the upper half of the drum and from there drops onto items in the drum.

2. A washing machine according to claim 1, in which the drum includes an axial water inlet at the rear of the drum, and the generally radial ducts are also provided along the back of the drum to the rear end of each channel.

3. A washing machine according to claim 1 or claim 2, in which three or more channels are provided, around the inner circumference of drum.

4. A washing machine according to claim 1 in which channels are provided parallel to the axis of rotation of the drum.

5. A washing machine according to claim 1, in which the valve includes a closed-ended spigot which extends into the drum from the center of the rear plate of the drum and which includes a hole directed generally upright in a side wall of the spigot.

6. A washing machine according to claim 5, in which the generally radial ducts terminate at the center of the drum by providing a sleeve, fitting over, being capable of rotating with respect to, and forming a liquid-tight seal with the outside of the spigot.

7. A washing machine according to claim 1, in which the valve is formed by providing an axial hub from which the radial channels open, and providing a loose disc within the hub, the disc having a diameter smaller than that of the hub, and including generally radial grooves through which water can pass.

8. A washing machine according to claim 1, in which the channels are curved around part of the circumference of the drum as they extend towards the front of the drum.

9. A washing machine according to claim 8, in which each of the channels extends about 90° around the drum so that, when one end of the channel is at its highest position, the other end is at a substantially lower position.

10. A washing machine according to claim 1, in which the channels are raised inwardly of the inner surface of the drum, and thereby act as agitators to agitate the items in the drum during rotation of the drum.

11. A washing machine according to claim 1, in which the drum is in the form of a removable basket which is received within a permanently fixed rotatable drum of the washing machine.

12. A washing machine according to claim 11, in which the generally radial channels and/or all or part of the valve are provided in the back of the basket, or on the rear of the drum which receives the basket.

13. A washing machine according to claim 1, in which the drum is rotatable about an axis inclined to the horizontal.

14. A washing machine including a rotatable drum having a number of channels extending substantially along its length, the channels including holes along their length, generally radial connecting ducts leading from the center of the drum to the channels, a pump arranged to pump water through the connecting ducts and into the channels, and a closed-ended spigot extending into the drum from the rear plate of the drum and including a hole directed generally upright in a side wall of the spigot, the radial connecting ducts terminating in a sleeve fitting over, being capable of rotating with respect to, and forming a liquid tight seal with the outside of the spigot so that, in use, water provided by the pump is directed through the opening in the spigot towards the channel or channels in the upper half of the drum and from there drops onto items in the drum.

15. A washing machine according to claim 14, in which the drum is rotatable about an axis inclined to the horizontal.

16. A washing machine according to claim 14, in which the drum is in the form of a removable basket which is received within a permanently fixed rotatable drum of the washing machine.

17. A washing machine according to claim 16, in which the radial connecting ducts are provided in the back of the basket.

18. A washing machine including a rotatable drum having a number of channels extending substantially along its length, the channels including holes along their length, generally radial connecting ducts leading from the center of the drum to the channels, a pump arranged to pump water through the connecting ducts and into the channels, an axial hub from which the radial channels extend, and a loose disc provided within the hub, the disc having a diameter smaller than that of the hub and including generally radial grooves through which water can pass so that, in use, water provided by the pump is directed by the radial grooves towards the channel or channels in the upper half of the drum and from there drops onto items in the drum.

19. A washing machine according to claim 18, in which the drum is rotatable about an axis inclined to the horizontal.

20. A washing machine according to claim 18, in which the drum is in the form of a removable basket which is received within a permanently fixed rotatable drum of the washing machine.

21. A washing machine according to claim 20, in which the radial connecting ducts are provided in the back of the basket.

* * * * *